United States Patent [19]

Glanzmann

[11] Patent Number: 4,775,137

[45] Date of Patent: Oct. 4, 1988

[54] APPARATUS FOR GATHERING SQUARE FOLDED SHEETS IN BOOKBINDING MACHINES

[75] Inventor: Alfred Glanzmann, Reiden, Switzerland

[73] Assignee: Grapha-Holding AG, Hergiswil, Switzerland

[21] Appl. No.: 824,619

[22] Filed: Jan. 31, 1986

[30] Foreign Application Priority Data

Feb. 7, 1985 [CH] Switzerland ..... 549/85

[51] Int. Cl.[4] ..... B65H 39/02

[52] U.S. Cl. ..... 270/54; 271/14

[58] Field of Search ..... 270/54–58, 270/53; 198/644; 271/14

[56] References Cited

U.S. PATENT DOCUMENTS

| | | | |
|---|---|---|---|
| 3,650,524 | 3/1972 | Hepp | 270/57 |
| 3,661,380 | 5/1972 | Muller | 270/54 |
| 3,711,084 | 1/1973 | Hart et al. | 270/57 |
| 3,899,165 | 8/1975 | Abram et al. | 270/54 |
| 4,083,551 | 4/1978 | Denis | 270/57 |
| 4,221,373 | 9/1980 | Hans | 270/54 X |
| 4,275,873 | 6/1981 | Rathert | 270/54 |
| 4,350,327 | 9/1982 | Muller | 270/54 |
| 4,470,588 | 9/1984 | Geiser | 270/57 |
| 4,497,479 | 1/1985 | Pessina | 270/54 |
| 4,564,186 | 1/1986 | Clarke, Jr. et al. | 270/54 |

FOREIGN PATENT DOCUMENTS 2009629 12/1970 Fed. Rep. of Germany ..... 270/53

*Primary Examiner*—E. H. Eickholt

*Attorney, Agent, or Firm*—Peter K. Kontler

[57] ABSTRACT

The backs of a stack of square folded sheets in a gathering apparatus rest on the upper side of the upper reach of an endless belt, and successive sheets of the stack are withdrawn by the gripper of a rotating drum which delivers a succession of discrete sheets into the nip of two rotary opening conveyors serving to deposit opened sheets on the straight upper reach of a chain conveyor. The folded edges of the folded sheets are located ahead of the unfolded edges, as considered in the direction of travel of the upper reach of the chain conveyor, when the sheets are in the process of descending onto the chain conveyor, and the axes of the drum and opening conveyors make acute angles with and slope toward the upper reach of the chain conveyor counter to the direction of travel of the upper reach. The upper side of the belt is parallel to the axes of the drum and opening conveyors and also slopes toward the upper reach of the chain conveyor counter to the direction of travel of the upper reach. Such mode of depositing square folded sheets prevents their unfolded edges from interfering with predictable deposition, even when the chain conveyor is to receive sheets at frequent intervals.

8 Claims, 2 Drawing Sheets

Fig. 4
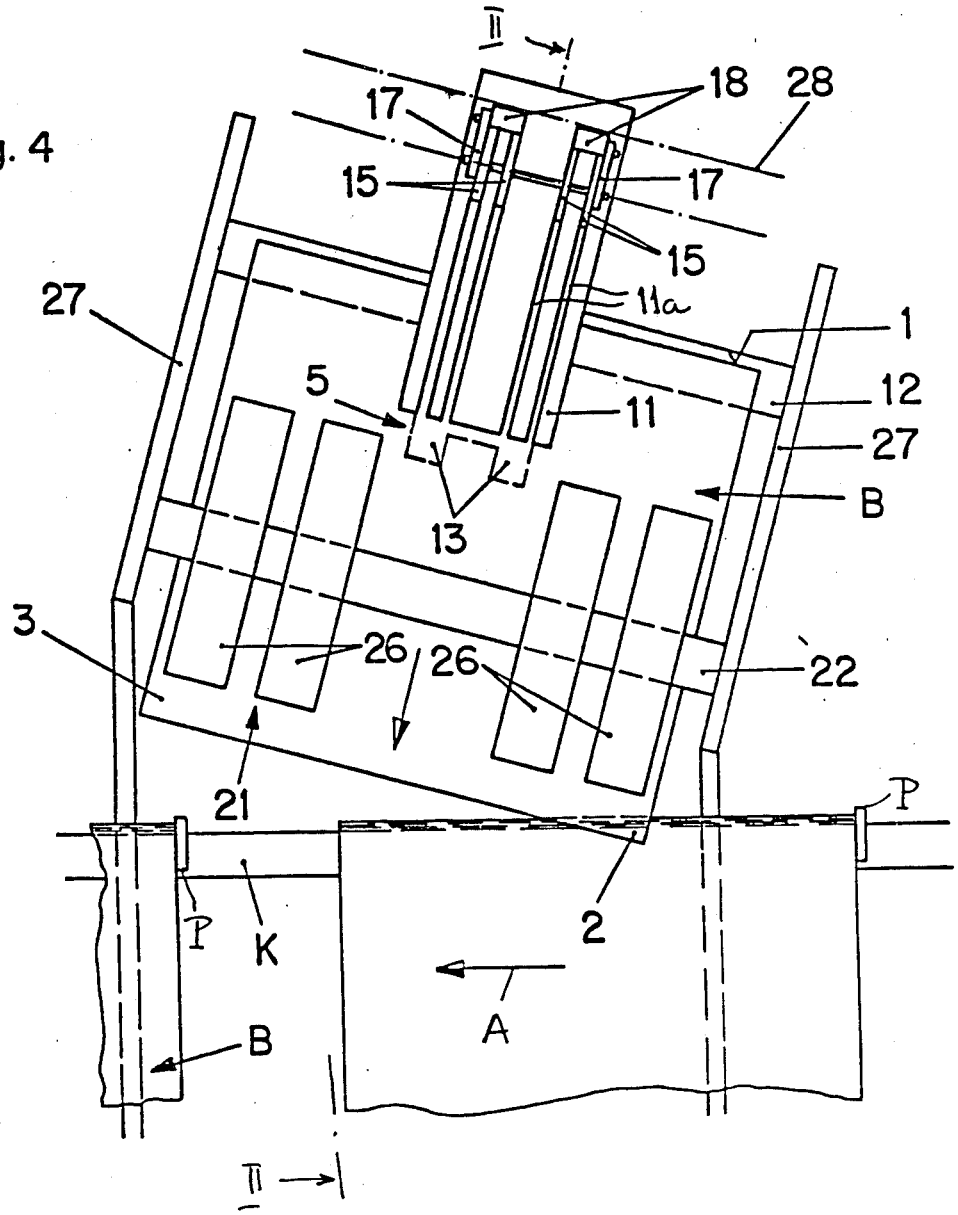
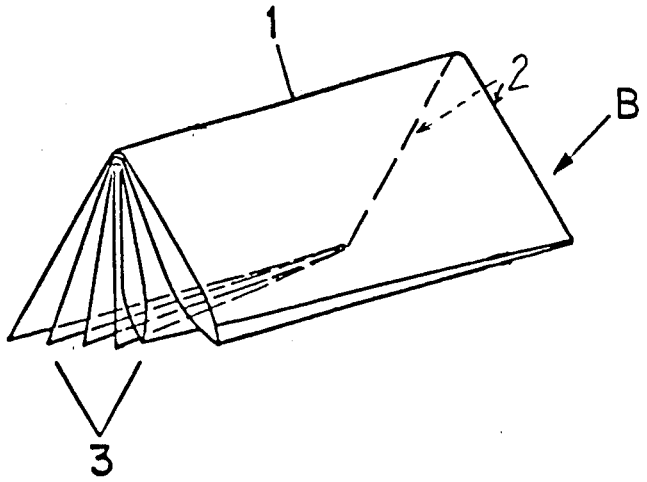
Fig. 1

APPARATUS FOR GATHERING SQUARE FOLDED SHEETS IN BOOKBINDING MACHINES

BACKGROUND OF THE INVENTION

The present invention relates to bookbinding and like machines in general, and more particularly to improvements in apparatus for gathering folded sheets on a moving conveyor so that the conveyor accumulates groups each containing two or more superimposed opened sheets which ride on the conveyor on their way to a stapling or other processing station.

Apparatus of the type to which the present invention pertains are disclosed in the commonly owned Swiss patent application Ser. No. 9140/80-0 as well as in numerous U.S. and foreign patents of the assignee. Reference may be had, for example, to U.S. Pat. Nos. 4,085,927, 4,491,311 and 4,401,299 whose disclosures are incorporated herein by reference.

A drawback of presently known apparatus for gathering folded sheets is that they cannot predictably manipulate so-called square folded sheets wherein two closed or folded and several unfolded or non-folded edges extend transversely of the folded back. The reason is that, when a freshly opened square folded sheet is allowed to descend toward, or is propelled onto, the conveyor which gathers the deposited sheet with one or more additional sheets to advance the thus obtained group to the stapling station or to another processing station, the unfolded edges of the descending square folded sheet continue to open up under the action of air and interfere with predictable deposition of the sheet on the conveyor, especially if the transfer of such sheets from a magazine to the conveyor must take place at frequent intervals, i.e., when successive opened sheets travel at a high speed between the so-called spreading or opening conveyors and the upper reach of a customary chain conveyor for opened sheets.

Attempts to overcome the just discussed problems which arise in connection with the gathering of square folded sheets include such positioning of stops which are adjacent to the path of movement of successive sheets immediately upon extraction from the magazine that the folded backs of the freshly extracted sheets are inclined with reference to the path of movement of opened sheets on the upper reach of the chain conveyor. The arrangement is such that the folded edges of the opened sheets are located ahead of the unfolded edges, as considered in the direction of travel of the upper reach of the chain conveyor, and that the opening or spreading conveyors positively entrain and guide the folded edges to a level below the upper reach so as to ensure that the fluttering unfolded (trailing) edges cannot interfere with predictable deposition of the sheets. This proposal exhibits the serious drawback that each freshly extracted sheet must change its orientation with reference to the withdrawing drum (in order to change the orientation of the folded back relative to the path of movement of the upper reach of the chain conveyor). Such change of orientation entails deformation of and/or other damage to the sheets, especially when the sheets must be transferred at a high frequency in a modern gathering apparatus. Moreover, a deformed or otherwise damaged sheet cannot be deposited on the chain conveyor with a required degree of predictability so that the shifting of sheets with reference to the withdrawing drum is to no avail.

OBJECTS AND SUMMARY OF THE INVENTION

An object of the invention is to provide a novel and improved apparatus which can gather square folded sheets with a heretofore unmatched degree of reliability and predictability.

Another object of the invention is to provide a gathering apparatus wherein the orientation of successive sheets with reference to the withdrawing conveyor need not be changed during extraction of such sheets from the magazine.

A further object of the invention is to provide the gathering apparatus with a novel and improved magazine for square folded sheets and with novel and improved means for transferring successive sheets from the magazine into the path wherein the sheets advance to the next processing station.

An additional object of the invention is to provide an apparatus which can gather square folded sheets with a heretofore unmatched degree of predictability and without deforming and/or otherwise damaging the sheets, even if the apparatus must operate at speeds which are required in ultramodern high-speed bookbinding and like machines.

Still another object of the invention is to provide a novel and improved method of orienting various components of a gathering apparatus for square folded sheets with reference to the conveyor which transports the sheets toward the next processing station.

Another object of the invention is to provide a novel and improved machine which embodies the above outlined apparatus.

The invention resides in the provision of an apparatus for gathering folded sheets of the type having a folded back, preferably for gathering square folded sheets of the type having a folded back and spaced-apart folded and unfolded (non-folded) edges extending transversely of the folded back. The apparatus comprises conveyor means (e.g., an endless chain conveyor) having an elongated portion (preferably the upper reach of the chain conveyor) which is arranged to move in a predetermined direction along a predetermined path (such path is preferably a straight path), a source of folded sheets adjacent to the path, and means for transferring folded sheets seriatim from the source into the path. The transferring means includes a plurality of transfer elements which are rotatable about predetermined axes each of which is inclined with reference to the path. Each axis preferably makes with the path an acute angle and slopes toward the path counter to the predetermined direction. The axes are preferably parallel to each other.

The transfer elements preferably include a first conveyor (e.g., a rotary drum) having means for withdrawing successive sheets from the source, and two additional conveyors having means for opening up successive withdrawn sheets and for depositing the thus opened sheets on the elongated portion of the conveyor means. The construction and mounting of the source and of the transferring means are such that the first conveyor delivers to the additional conveyors square folded sheets in an orientation such that the folded edges of the sheet which is about to enter the path are located ahead of the unfolded edges, as considered in the predetermined direction.

The source can comprise an endless belt conveyor having a supporting surface located in a plane which is inclined with reference to the predetermined path, preferably through the same acute angle as the axes of the rotary elements of the transferring means, i.e., the supporting surface is parallel to the axes and slopes toward the path counter to the predetermined direction.

The novel features which are considered as characteristic of the invention are set forth in particular in the appended claims. The improved gathering apparatus itself, however, both as to its construction and its mode of operation, together with additional features and advantages thereof, will be best understood upon perusal of the following detailed description with reference to the accompanying drawing.

BRIEF DESCRIPTION OF THE DRAWING

FIG. 1 is a perspective view of a square folded sheet which can be manipulated in the apparatus of the present invention;

FIG. 4 is a fragmentary elevational view of the apparatus as seen in the direction of arrow IV in FIG. 2.

DESCRIPTION OF THE PREFERRED EMBODIMENTS

Figure 2:
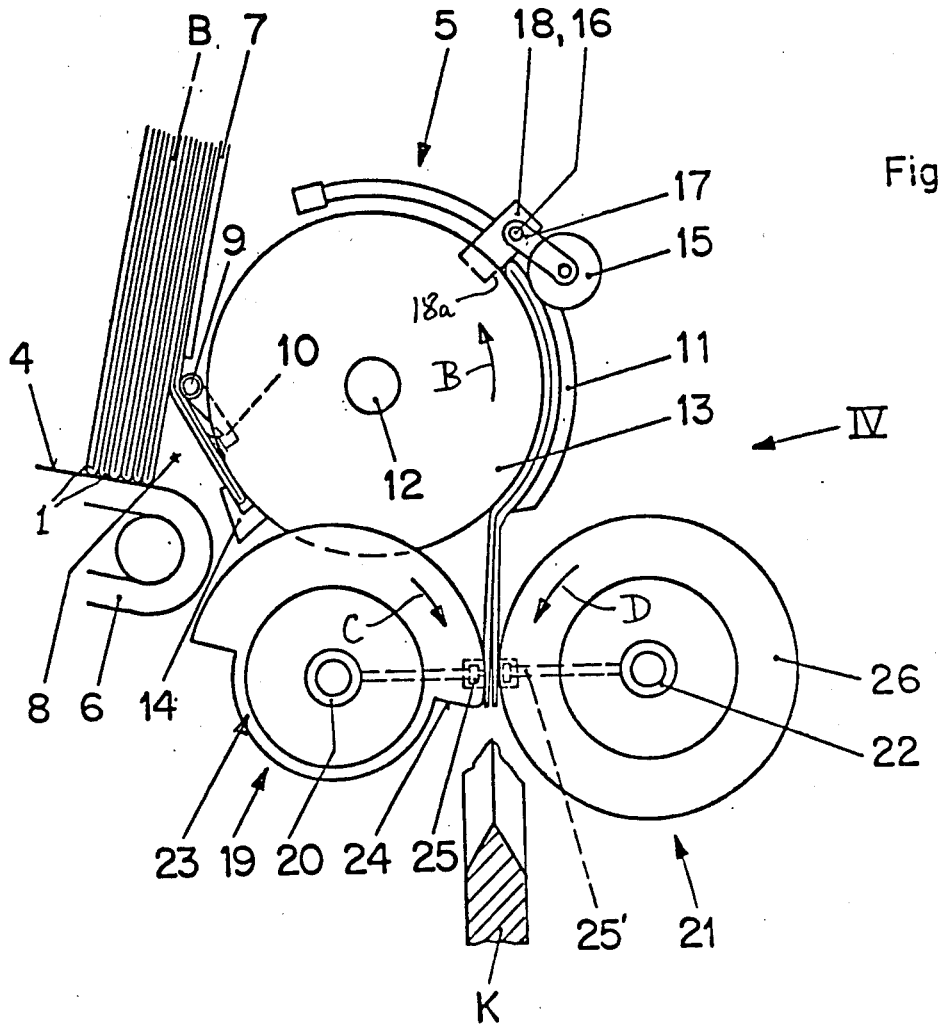
FIG. 2 is fragmentary transverse sectional view of the gathering apparatus, substantially as seen in the direction of arrows from the line II—II of FIG. 4.

The square folded sheet B of FIG. 1 is folded three times so that it comprises a folded back 1, closed or folded edges 2 which extend transversely of the back 1, and unfolded or non-folded (open) edges 3 which also extend transversely of the back 1. Sheets of the type shown at B are delivered to the improved gathering apparatus in the form of a scalloped stream or in the form of stacks and are deposited on the supporting surface 4 of the upper stretch of an endless belt conveyor 6 which can be said to constitute a magazine for or a source of sheets B and further includes a plate-like abutment 7 for the foremost sheet B of the stack on the supporting surface 4. The sheets B are delivered onto the conveyor 6 in such orientation that their folded backs 1 abut the supporting surface 4. As can be seen in FIG. 1 of the aforementioned commonly owned U.S. Pat. No. 4,401,299, the conveyor 6 constitutes one of several sources of or magazines for folded sheets, and each such source is adjacent to a different portion of an elongated straight path for the upper reach of an endless chain conveyor K (corresponding to the chain conveyor 2 in the apparatus of U.S. Pat. No. 4,401,299). The upper reach of the conveyor K advances in the direction of arrow A (shown in FIG. 4) when the improved apparatus is in actual use. As can be seen in FIG. 4, the upper reach of the conveyor K carries a plurality of suitably spaced-apart longitudinally adjustable pushers P which engage the trailing edges (3) of successively delivered sheets B and cause the thus entrained sheets B to advance in the direction of arrow A at the exact speed of the conveyor K.

The means for transferring successive discrete sheets B from the surface 4 of the upper reach of the belt conveyor 6 onto the upper reach of the chain conveyor K comprises a plurality of rotary elements including a drum-shaped first conveyor 5 and two additional conveyors 19, 21 constituting so-called opening or spreading conveyors and serving to deposit successive opened sheets B on, or to propel such sheets onto, the upper reach of the chain conveyor K. The transferring means further comprises a rockable hollow shaft 9 for one or more (normally two) suction cups or suction heads 10 which can move back and forth about the axis of the shaft 9 and are connectable with a suitable suction generating device (not specifically shown) by way of the hollow shaft 9 so as to attract the lower portion of the foremost sheet B on the supporting surface 4 and to pull such lower portion into a space or gap 8 below the lower edge of the stationary abutment 7 in order to ensure that the deflected back 1 of such sheet B can be engaged and entrained by a suitable gripper 14 on the drum-shaped withdrawing conveyor 5. The rocking movements of the hollow shaft 9 for the suction cups 10 are synchronized with the angular movement of the conveyor 5 in such a way that the suction cups pull the lower portion of the foremost sheet B into the space 8 during a predetermined stage of the respective revolution of the conveyor 5. The latter is continuously driven by a shaft 12 which is journalled in a frame including two sidewalls or cheeks 27 shown in FIG. 4. A partly cylindrical shroud 11 is adjacent to a portion of the periphery of the conveyor 5 and is fixedly mounted in the frame. The direction in which the conveyor 5 is driven by its shaft 12 is indicated by the arrow B'. The center of curvature of the concave surface of the shroud 11 is located on the axis of the shaft 12.

As can be seen in FIG. 4, the conveyor 5 comprises two spaced-apart concentric discs 13 which are affixed to the shaft 12 and flank a conventional stationary cam (not shown) which serves to move the gripper 14 with reference to the discs 13 when the shaft 12 is driven by the prime mover of the machine embodying the improved apparatus. The gripper 14 is mounted on the discs 13 and orbits about the shaft 12. A cam or other suitable motion transmitting means is provided on the shaft 12 to rock the shaft 9 for the suction cups 10 in response to rotation of the discs 13. The gripper 14 can comprise two or more aligned jaws which engage and entrain the back 1 of the foremost sheet B on the supporting surface 4 (after such back has been flexed by the suction cups 10) whereupon the thus engaged sheet shares the movement of the gripper 14 about the shaft 12 and advances its back 1 toward and into engagement with a stop 18 on the shroud 11. During such movement of the sheet B along the concave inner side of the shroud 11, the back 1 advances past and beyond one or more spring-biased or weighted rollers 15 which urge the sheet B against the peripheral surfaces of the discs 13. The rollers 15 are mounted on levers 17 which are pivotally secured to the stop 18 by pins 16. The stop 18 can comprise several sections which are adjustably affixed to the shroud 11 so that the apparatus can transfer longer or shorter sheets (as measured in the circumferential direction of the conveyor 5). The aforementioned cam between the discs 13 causes the gripper 14 to release the back 1 of the sheet B not later than when the back reaches the stop 18 so that the sheet comes to a halt while the gripper 14 is free to advance toward the space 8 in order to engage the back 1 of the next-following sheet B. As can be seen in FIG. 4, each of the rollers 15 can comprise two discrete wheels in the form of narrow discs which can extend into and inwardly beyond arcuate slots 11*a* of the shroud 11. The slots 11*a* extend into the circumferential direction of the conveyor 5. Each pair of wheels is arranged to urge the adjacent portion of a sheet B against the peripheral surface of the respective disc 13.

The speeading or opening conveyor 19 is mounted on a hollow shaft 20 which is parallel with a hollow shaft 22 for the spreading or opening conveyor 21. The conveyor 19 comprises four spaced-apart coaxial discs 23 each of which has a larger-diameter segment 23*a* and a smaller-diameter segment 23*b*. Each of these segments extends along an arc of 180 degrees, and the segments 23*a*, 23*b* of each disc 23 define a pair of radially extending shoulders 24. The peripheral surfaces of the segments 23*a* are provided with suction ports 25 which are closely or immediately adjacent to the leading shoulder 24 (the direction in which the discs 23 of the conveyor 19 rotate when the shaft 20 is driven is indicated by the arrow C) and serve to attract one exposed surface of the square folded sheet B whose back 1 abuts the stop 18. This can be seen in FIG. 2. The suction ports 25 are connected with the axial passage of the shaft 20 by radially extending channels 25*a* which are machined into the respective discs 23 of the conveyor 19. The arrangement is such that the ports 25 are connected with a suction generating device (not specifically shown) during certain stages of each revolution of the shaft 20. Each port 25 can contain a suction cup or any other suitable means for attracting the adjacent portion of a sheet B as soon as the back 1 of such sheet strikes against the stop 18 and is ready to be moved downwardly (with simultaneous opening) to descend onto the upper reach of the chain conveyor K.

The second opening or spreading conveyor 20 comprises four spaced-apart coaxial circular discs 26 each of which has one or more suction ports 25' adapted to communicate with the axial passage of the shaft 22 by way of one or more radially extending channels 25*a'*. As can be seen in FIG. 2, the orientation of the channels 25*a*, 25*a'* relative to each other is such that the suction ports 25 are located exactly opposite the suction ports 25' when they reach the nip of the conveyors 19 and 21. The direction in which the shaft 22 is driven is indicated by the arrow D.

Figure 3:
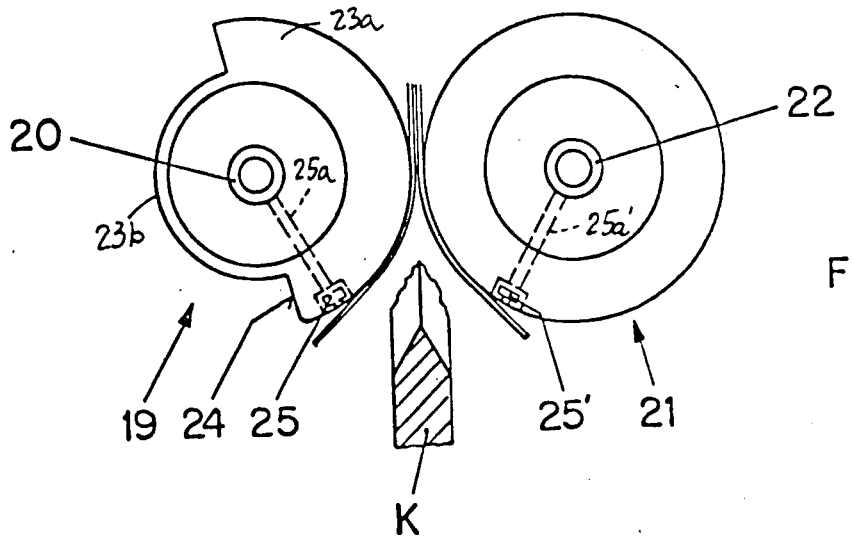
FIG. 3 shows a detail of the structure which is illustrated in FIG. 2 but with the additional conveyors of the sheet transferring means in different angular positions.

The shafts 20 and 22 carry mating gears which ensure that the orbital movements of the suction ports 25 are invariably synchronized with those of the suction ports 25' so that a sheet B which has been caused to enter the nip of the conveyors 19, 21 (see FIG. 2) is compelled to open in response to further angular movement of the discs 23 and 26 (see FIG. 3). The arrangement is preferably such that the synchronizing gears are mounted at the first ends of the shafts 20, 22 and the second ends of these shafts are provided with sleeves for attachment to a conduit (e.g., a flexible hose) leading to the suction intake of the suction generating device. The axial passages of the hollow shafts 20, 22 can be connected with the suction generating device during each stage of rotation of the conveyors 19 and 21.

The end portions of the shafts 20 and 22 are journalled in the respective cheeks 27 of the frame (see FIG. 4) and their axes are parallel to the axis of the shaft 12. In accordance with a feature of the invention, the axes of the shafts 12, 20 and 22 are inclined with reference to the straight path of movement of the upper reach of the chain conveyor K so that such path and the three axes make an acute angle and the axes slope downwardly toward such path counter to the direction (arrow A) of movement of the pushers P with the upper reach of the conveyor K. In accordance with another feature of the invention, the supporting surface 4 of the upper reach of the belt conveyor 6 is parallel with the axes of the shafts 12, 20, 22 and is also inclined with reference to the path for the upper reach of the chain conveyor K through the aforementioned acute angle. The surface 4 slopes downwardly toward the path of the upper reach counter to the direction which is indicated by the arrow A. The arresting surfaces 18*a* on the sections of the stop 18 for the backs 1 of successive sheets B on the conveyor 5 are disposed in a common plane and are parallel to the axis of the shaft 12 so that the orientation of the sheet B, which is engaged and entrained by the gripper 14, with reference to the conveyor 5 need not be changed during extraction of such sheet from the magazine including the conveyor 6 and abutment 7. In other words, the sheets B need not be shifted with reference to the conveyor 5 during any stage of their extraction from the space behind the abutment 7. The back 1 of the sheet B which is shown in FIG. 2 between the peripheries of the discs 13 and the concave side of the shroud 11 is parallel to the axes of the shafts 12, 20 and 22, i.e., such back makes with the path of the upper reach of the chain conveyor K an acute angle and slopes toward such path counter to the direction which is indicated by the arrow A.

The operation of the gathering apparatus is as follows:

The suction cups 10 are caused to deflect the lower portion (back 1) of the foremost sheet B on the conveyor 6 during a predetermined stage of the respective revolution of the conveyor 5 so that the back 1 can be engaged and entrained by the jaw or jaws of the gripper 14. The back is transported toward and advances along the concave side of the shroud 11 until it strikes (simultaneously) against all sections (surfaces 18*a*) of the stop 18. At such time, the sheet B is already biased by the wheels of the rollers 15 so that it bears against the peripheral surfaces of the discs 13. The gripper 14 is caused to release the back 1 as soon as or immediately before the back reaches the stop 18 and, at such time, the lower marginal portions of the sheet B are located in the nip of the spreading or opening conveyors 19 and 21 (see FIG. 2). Rotary movements of the discs 23 are synchronized with rotary movements of the discs 13 in such a way that the smaller-diameter segments 23*b* face toward the space 8 during extraction of a sheet B from the space behind the abutment 7. This enables the sheet B to bypass the discs 23 during travel of its back 1 toward and into contact with the surfaces 18*a* of sections of the stop 18. The peripheral surfaces of the larger-diameter segments 23*a* of the discs 23 come into contact with the adjacent outer side of the sheet B, and the suction ports 25 attract such outer side as soon as the back 1 reaches the stop 18. The leading end of the peripheral surface of each larger-diameter segment 23*a* further serves to flex the adjacent lower marginal portion of the sheet B toward the peripheral surfaces of the discs 26 so that the suction ports 25' can attract the other outer side of the lower marginal portion of the sheet (this is shown in FIG. 2). The ports 25 and 25' thereupon move apart (i.e., from the positions shown in FIG. 2 toward and beyond those shown in FIG. 3) and thereby automatically open or spread the sheet B so that it is ready to ride on the upper reach of the chain conveyor K and to be entrained by the oncoming pusher P. The suction ports 25' begin to attract the adjacent outer side of the lower marginal portion of the sheet B (whose back 1 abuts against the stop 18) not later than when the distance between the ports 25 and 25' is reduced to a minimum, i.e., when the leading shoulders 24 of the discs 23 are nearest to the discs 26 of the conveyor 21.

The arrangement is preferably such that the peripheral surfaces of the segments 23a cooperate with the peripheral surfaces of the corresponding discs 26 to clamp the lower marginal portion of the sheet B not later than in the angular positions shown in FIG. 2 so that the sheet B is then pulled downwardly by the orbiting suction ports 25, 25' as well as by the peripheral surfaces of the segments 23a in conjunction with the peripheral surfaces of the discs 26. The magnitude of the clamping force can be selected and maintained by appropriate selection of the minimal distance between the segments 23a and the respective discs 26. A reliable mechanical clamping action is desirable and advantageous in order to ensure that the sheet B is pulled downwardly at a predictable rate and overcomes the bias of the rollers 15 as well as the friction between its outer sides on the one hand and the adjacent surfaces of the discs 13 and shroud 11 on the other hand. The manner in which the ports 25, 25' are caused to communicate with the axial passages of the respective shafts 20, 22 when they reach the angular positions of FIG. 2, and thereupon continue to communicate with such axial passages until the spreading or opening of a descending sheet B is completed, is not specifically shown in the drawing. For example, the channels 25a and 25a' can contain solenoid-operated valves which open during predetermined stages of each revolution of the respective conveyors 19, 21 to thus ensure that the ports 25 and 25' can properly attract the adjacent portions of the sheet B while the latter is being pulled out of the arcuate gap between the discs 13 and shroud 11 by the peripheral surfaces of the segments 23a in cooperation with the peripheral surfaces of the discs 26. The peripheral surfaces of the segments 23a cooperate with the peripheral surfaces of the discs 26 for the additional purpose of preventing penetration of atmospheric air into the ports 25, 25' when such ports begin to communicate with the axial passages of the respective shafts 20 and 22. This ensures that the ports 25, 25' can properly attract and open the sheet B which is in the process of descending from the conveyor 5 onto the upper reach of the conveyor K. Once the outer sides of the sheet B are moved sufficiently close to the ports 25 and 25', these ports attract the respective outer sides until the spreading operation is completed. At such time, the back 1 of the sheet B has descended beyond the lower edge of the shroud 11 and the ports 25, 25' are again disconnected from the passages of the respective shafts 20, 22 so that the sheet B can descend onto the upper reach of the conveyor K in front of the oncoming pusher P.

The orientation of sheets B on the supporting surface 4 of the conveyor 6 is such that the closed or folded edges 2 of the sheet B which is in the process of descending onto the conveyor K are located ahead of the respective open or non-folded edges 3 (as considered in the direction of arrow A). The suction ports 25 and 25' attract the adjacent outer sides of the descending sheet B until after the lowermost portions of the folded edges 2 have descended to a level below the upper reach of the conveyor K. This ensures that the upper reach can penetrate between the two halves of the folded sheet B and that eventual fluttering of the trailing or non-folded edges 3 in response to rapid descent of the sheet toward the path for the upper reach of the conveyor K cannot adversely affect the accuracy of deposition of the sheet on the chain conveyor, even if the sheets are caused to descend at a high speed. The upper reach of the conveyor K acts not unlike a wedge which penetrates between the two halves of the sheet B before the back 1 comes to rest on the upper reach, and the wedge contributes significantly to a highly predictable deposition of successive sheets B in front of the oncoming pushers P.

An important advantage of the improved apparatus is that it can ensure predictable deposition of opened sheets B on the conveyor K regardless of whether the sheets are caused to descend at a low speed, at a moderate speed or at a very high speed. This is attributed to the aforediscussed inclination of the axes of shafts 12, 20 and 22 relative to the path for the upper reach of the conveyor K and also to the aforediscussed inclination of the supporting surface 4 with reference to such path.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for gathering folded sheets of the type having a folded back, comprising conveyor means having an elongated portion arranged to move in a single predetermined direction along a predetermined path; a source of folded sheets adjacent to said path; and means for transferring folded sheets seriatim from said source into said path, including a plurality of transfer elements rotatable about predetermined axes each of which is inclined with reference to said path, each of said axes making with said path at all times an acute angle and sloping toward said path counter to said direction.

2. The apparatus of claim 1, wherein said axes are substantially parallel to each other.

3. The apparatus of claim 2, wherein said path is straight.

4. The apparatus of claim 1, wherein said elements include a first conveyor having means for withdrawing successive folded sheets from said source, and two additional conveyors having means for opening successive withdrawn sheets and for depositing the thus opened sheets on said portion of said conveyor means.

5. The apparatus of claim 4 for gathering square folded sheets each having folded edges and unfolded edges extending transversely of the respective folded back, wherein said first conveyor is arranged to deliver to said additional conveyors square folded sheets in such orientation that the folded edges of the sheet entering said path are located ahead of the unfolded edges, as considered in said direction.

6. The apparatus of claim 1, wherein said source has a sheet supporting surface located in a plane which is inclined with reference to said path.

7. The apparatus of claim 6, wherein said surface is parallel to said axes.

8. The apparatus of claim 7, wherein said surface slopes toward said path counter to said direction.

* * * * *